United States Patent [19]

Tully

[11] Patent Number: 4,979,383

[45] Date of Patent: Dec. 25, 1990

[54] LOCK HAVING MAID LOCKOUT AND DEADBOLT PROTECTOR

[75] Inventor: Clay E. Tully, Charlotte, N.C.

[73] Assignee: Yale Security, Inc., Monroe, N.C.

[21] Appl. No.: 408,568

[22] Filed: Sep. 18, 1989

[51] Int. Cl.[5] ..... E05B 49/00; E05B 59/00

[52] U.S. Cl. ..... 70/107; 70/276; 70/277; 70/278; 70/283; 70/DIG. 30

[58] Field of Search ..... 70/283, 481, 107, DIG. 30, 70/276, 277, 278; 292/144

[56] References Cited

U.S. PATENT DOCUMENTS

| | | | |
|---|---|---|---|
| 3,194,596 | 7/1965 | Jakeway | 292/DIG. 37 X |
| 3,228,717 | 1/1966 | Waller et al. | 292/70 |
| 3,543,546 | 12/1970 | Gallo | 292/144 X |
| 3,967,846 | 7/1976 | Schlage | 70/283 X |
| 4,125,008 | 11/1978 | Genest et al. | 70/277 X |
| 4,534,194 | 8/1985 | Aydin | 70/278 |

*Primary Examiner*—Lloyd A. Gall
*Attorney, Agent, or Firm*—Dallett Hoopes

[57] ABSTRACT

This lock, which may be coded-keycard operated, has a set-table device on the inside of the door by which the maid, for instance, can be locked out. The lockout setting device is preferably in the form of a pushbutton or deadbolt turnpiece which manipulates a switch in the code-receiving circuitry. The lockout setting is automatically cancelled when the latch is retracted. When the setting device comprises a deadbolt turnpiece, the deadbolt is biased toward retracted position and the setting device holds the deadbolt extended. When the latch is retracted in the latter version, the retraction cancels the lockout setting and permits the deadbolt to retract under the power of the deadbolt biasing spring.

The invention also includes a non-code-operated embodiment in which a deadbolt is spriing driven to retracted position as the latch is retracted in latching to protect the deadbolt, lock and door frame.

7 Claims, 7 Drawing Sheets

LOCK HAVING MAID LOCKOUT AND DEADBOLT PROTECTOR

BACKGROUND OF THE INVENTION

1. Field of the Invention

This invention relates to electrically driven locking systems comprising an exterior operator which is only operable after a proper code input, such as a magnetic stripe card or perforated card or manipulation of a keyboard is entered into the lock. More specifically, this invention relates to such a system additionally having means settable from the interior which maintains the exterior operator of the latch as inoperative despite the entry of the proper code input. The settable means may be set when a deadbolt is extended. The lockout is cancelled when the latch is retracted and in the deadbolt versions the deadbolt is retracted at the same time.

In hotels, motels and other multiple guest buildings the individual guest rooms are often equipped with electric lock systems which are operable from the hall side by a perforated card, a card having a magnetic stripe, or a numerical keyboard. Such code input is received by the system and electronically compared with the preset code. If there is a "match", the exterior door operator is then made operable so that the room may be entered. At all times, of course, the lock is operable from the inside of the room so that the occupant can freely leave the room.

There do arise occasions when the guest, wanting privacy or simply not to be disturbed, desires that the lock not operate from the outside even upon the input of a "matching" code. For instance, he may want to lock out the maid. Similarly, the occupant may even wish to lock out other occupants of the room for one reason or another.

At the same time, it should always be possible for the hotel manager, for instance, to get into the room with his code input in the event that the occupant, for instance, has not been heard from for two or three days, in the event of fire, or other special incidents.

For this reason, various levels or categories of keys have been made. For instance, a guest would have a key on one level of key control lockout, a maid on another level so she could, for instance, get into all the rooms on a floor, a service man on another level so that he could enter, for instance, all the rooms in a large area of the building and, finally, the hotel manager would have still another level. Such a "master key system" has been used in pin tumbler locks. It has also been used in electronic security systems, such as an arrangement being well disclosed in the U. S. Patent to Walter J. Aston, U.S. Pat. No. 4,396,914, which issued Aug. 2, 1983 to my assignee.

Electronic as well as non-electronic latchbolts of the prior art have sometimes been coupled with a deadbolt. A problem has arisen that such deadbolts may be thrown when the door is opened. When one attempts to close the door with the extended deadbolt, damage to the door, lock and/or door jamb may result. Also, since the door cannot close and latch with the deadbolt extended, the fire-stop capability of the door is compromised.

2. Description of Related Art including Information Disclosed under §§1.97 to 1.99

The above Aston patent gives the outline of an electronic security system having key card input. Code-receiving means are disclosed in U.S. Pat. No. 4,488,036 to Lawrence D. Butts which issued Dec. 11, 1984, assigned to my assignee.

A number of mechanical locking systems have provisions for maid lockout. An example is disclosed in U.S. Pat. No. 3,704,608 granted Dec. 5, 1972 to Heinz Kloosterziel, assigned to my assignee.

Also there have been in the art showings of means to protect the deadbolt. Examples are Ser. No. 07/254,170, filed Oct. 6, 1988 and assigned to my assignee, and Ser. No. 07/254,257, filed Oct. 6, 1988 and also assigned to my assignee.

An example of a lock on which the operation of the latchbolt automatically retracts the deadbolt is U.S. Pat. No. 4,183,563 issued Jan. 15, 1980 to W. E. Stevens and assigned to my assignee.

SUMMARY OF THE INVENTION

The present invention is an electrically driven lock which has code-receiving and enabling means adapted to make operable the exterior operator upon receiving suitable code input on the outside of the door.

An electric switch is provided which alters the electronic circuit in a way that blocks the operation of the door from the outside even though otherwise proper code input is received into the system. The switch actuator preferably includes a pushbutton arrangement on the inside lock housing wherein the side of the pushbutton has an irregular profile which affect the position of a lever, one end of which operates the switch and the other end of which is exposed to the operation of a cancelling pin on the latch retractor. Under this arrangement, when the pushbutton is pressed, the switch is put in a lockout-engaged condition as the lever moves to one position. When the latch retractor is retracted subsequently, the lever is moved to a second position which changes the switch to lockout-disengaged condition. The switch is electrically tied to the circuit board of the reader or other code-receiving circuit within the housing of the lock. Depending on how the switch is connected into the circuit the desired levels of master key will be blocked by the lockout system.

Alternatively, the electric switch may be moved by a cam fixedly mounted on the operating shaft of a turnpiece for a deadbolt usually positioned above the latchbolt. In such an arrangement the deadbolt may be biased toward the retracted position and when the bolt is extended, it may be held in that position against the force of a biasing spring by a lever similar to the one described above, the lever having a finger on its one end which fits into a notch in the periphery of the cam. In such a set-up the lockout switch is engaged by the cam whenever the deadbolt is extended, and the lockout is cancelled when the pin on the latch retractor moves the other end of the lever as described above.

In another version a detent holds the spring-biased deadbolt extended and the lever presses the deadbolt to overcome the detent and start the deadbolt on its travel toward retracted position.

Finally, the invention relates to means for protecting the deadbolt and frame of the associated door against the inadvertent or purposeful attempt to close a door with the deadbolt extended for, as described immediately above, the latch, on being retracted, will move the lever causing the deadbolt to rapidly retract, driven by its biasing spring. For such purposes, the lip on the latchbolt strike may be slightly extended to assure that there is ample time for the deadbolt to retract before the deadbolt strikes the frame of the door.

BRIEF DESCRIPTION OF THE DRAWINGS

Other features and objects of the invention will be apparent from a reading of the following specification and reference to the drawings, all of which disclose a non-limiting embodiment of the invention. In the drawings.

DESCRIPTION OF THE PREFERRED EMBODIMENT

Figure 1:
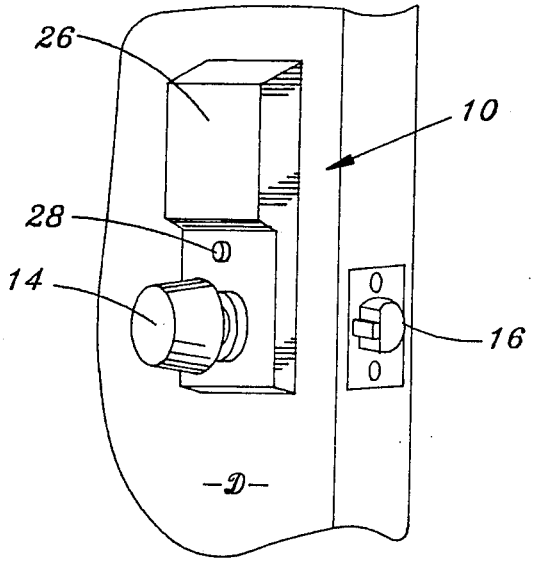
FIG. 1 is a fragmentary perspective view of the inside of a door D showing the lock installed on an inwardly opening door.
Figure 2:
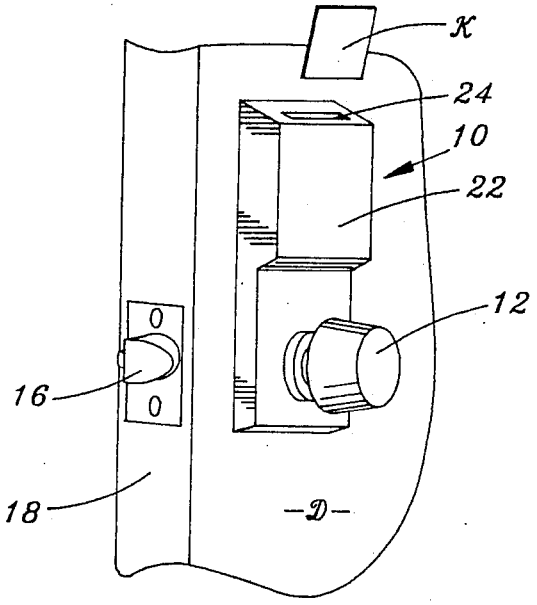
FIG. 2 is a fragmentary perspective view of a portion of the door showing the outside of the lock as would be seen in a hotel hallway, for instance.

FIGS. 1 and 2 show views of the inside and outside respectively of a lock embodying the invention, the lock being generally designated 10.

It comprises an exterior operator 12 which may be in the form of a knob as shown or a lever and an interior operator 14. A latch 16 is provided in the end of the door.

The exterior operator 12 passes through a housing 22 which may include a card reader as disclosed in Butts above by which the lock may receive a code on the keycard K inserted into the slot 24. The housing 22 may also enclose appropriate circuit boards bearing the logic well described in the above Aston patent.

The interior operator 14, coaxial with the outside operator, passes through an inside-the-room housing 26 which may house the batteries B for operating the solenoid 50 (FIG. 7) and the circuit boards within housing 22.

A disabling or maid lockout button 28 is provided and projects out an opening in the inside housing 26.

Figure 3:
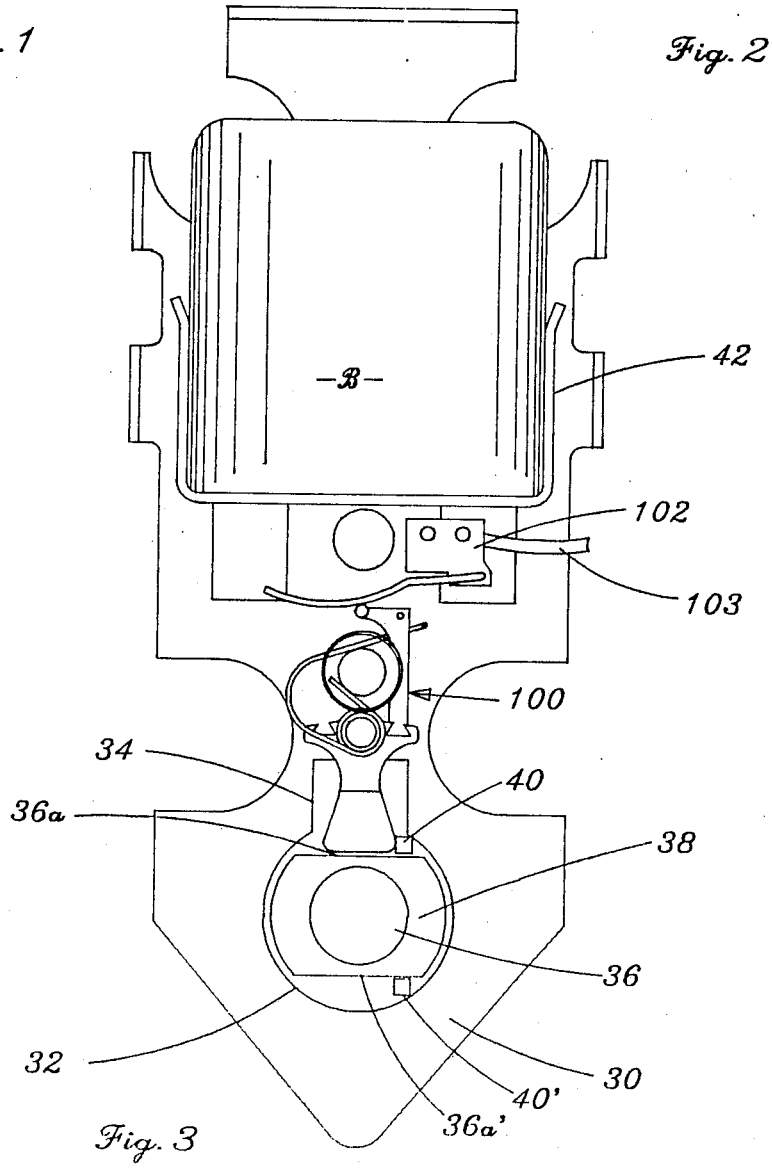
FIG. 3 is an enlarged elevational view showing the inside of the lock system with the housing and knob removed.

FIG. 3 shows the base plate 30 as it would appear if the inside operator 14 and the inside housing 26 were removed. The plate is apertured as at 32 with an upward extension 34 to permit the passage of the tubular spindle 36 and threaded flange 38 of the interior operator.

A cancelling pin 40 to be described is mounted on part of the latch retractor and operates freely in the aperture extension 34.

Figure 7:
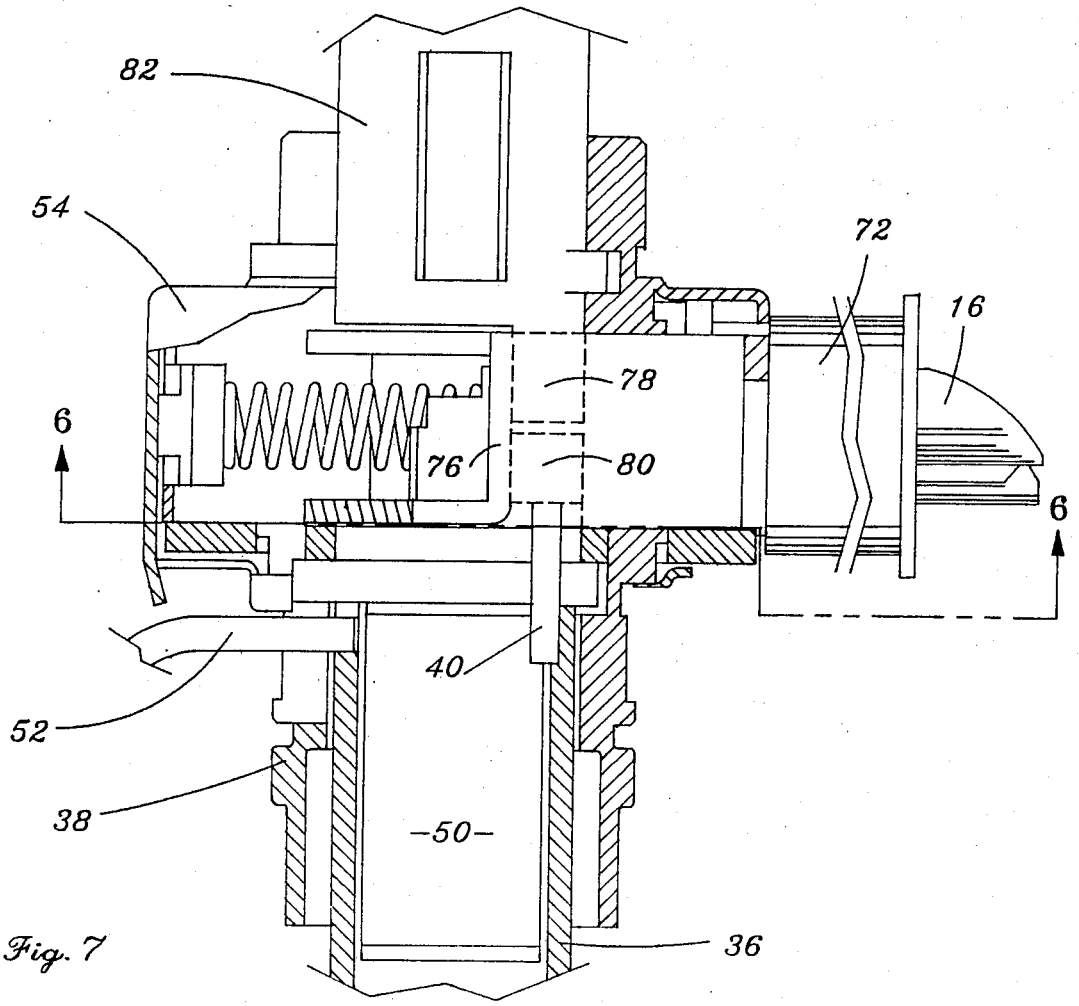
FIG. 7 is an enlarged fragmentary view disclosing the lock housing and showing the retractor and cancelling pin and taken on line 7—7 of FIG. 6.

At the upper end of the base plate 30 a bracket 42 is provided which frictionally holds a pack of batteries B for the operation of blocking solenoid and the code-receiving and enabling means all as described in the above Aston patent. Suitable conductors may extend through an opening in the door and convey power over to the reader and circuit board within the housing 22. One of the wires may extend from the reader through the door to the solenoid 50 mounted inside the tubular spindle 36. These wires are generally not shown in order to avoid unnecessary complications of the drawings. A portion of the wire 52 to the solenoid is shown in FIG. 7.

Figure 6:
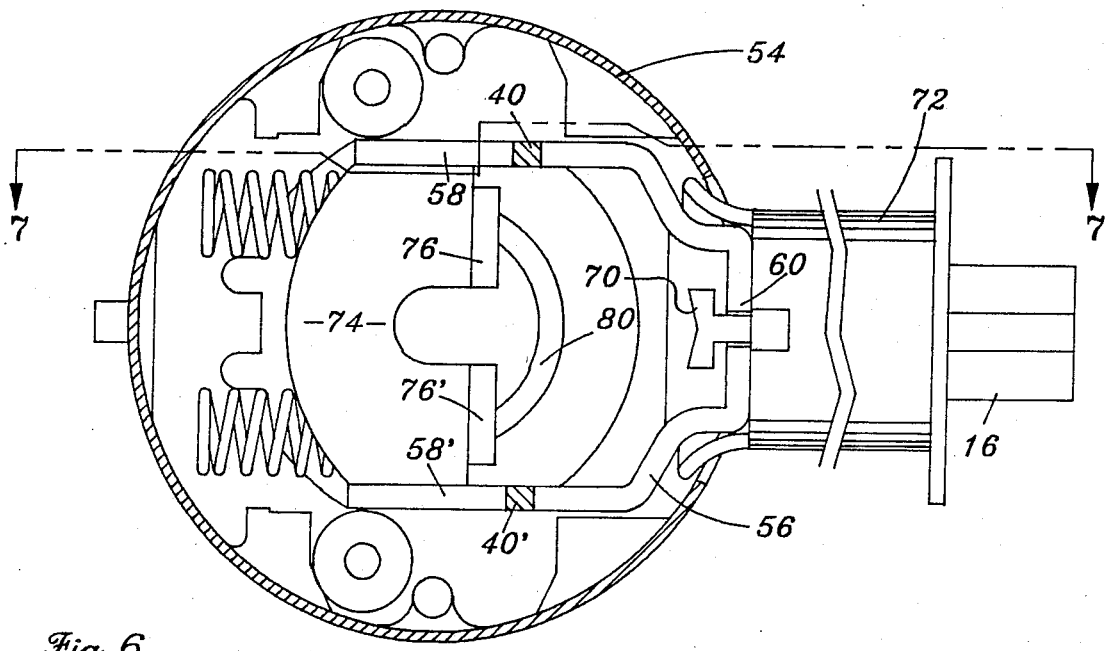
FIG. 6 is an enlarged view of the cylindrical housing, retractor and latch taken on the line 6—6 of FIG. 7.

Referring to the mechanical lock and latch structure, FIG. 6 shows in section the housing 54 of a cylindrical lockset. It comprises a latch retractor 56 which is defined by a pair of legs 58 and 58' between which is the typical bight 60 which engages the latch tailpiece 70 of the latch 72 as shown.

The legs 58 and 58' are joined by the retractor plate 74 which is formed with a pair of angles 76 and 76' which are alternately engaged between ends of the spindle pull-back scoops 78 and 80, one for each operator spindle 82 in the case of the exterior spindle and 36 for the interior spindle.

Thus, as is conventional, rotation of the operators 12 and 14 rotates the respective spindles and also causes rotation of the appropriate pull back scoops 78 and 80 to engage the angles 76, 76' depending on the sense of rotation of the spindle. This causes the retractor to move leftwardly (FIG. 6) to retract the latch.

The retractor will also move leftwardly if the latch is depressed as, for instance, when the latch bolt hits the strike in normal closing. Thus, retraction of the bolt, either in automatic closing of the door or movement of one of the operators 12, 14 will cause the cancelling pin 40 to move leftwardly (FIG. 6, 7) for purposes which will appear.

The pin 40' (FIG. 3) serves as cancelling pin if the hand of the door is reversed so that the latch, for instance, in FIG. 7 would extend to the left instead of the right. In that event pin 40' would be above the spindle 36.

Figure 4:
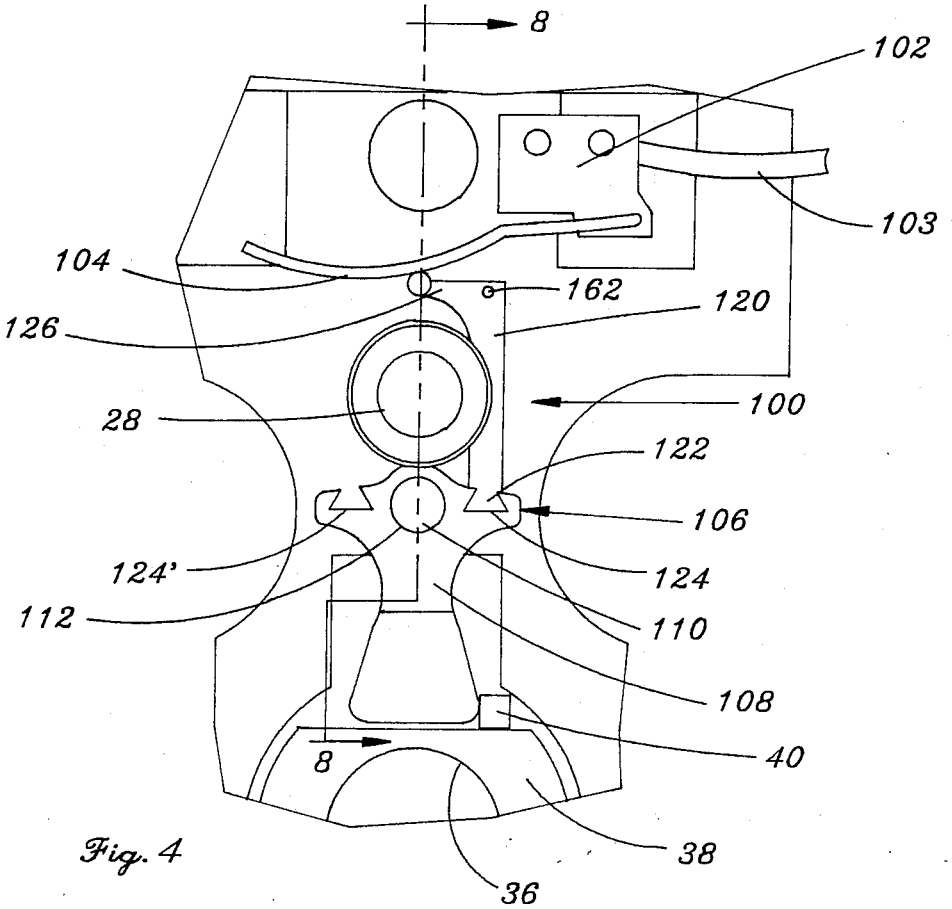
FIG. 4 is an enlarged view of the lockout means.
Figure 5:
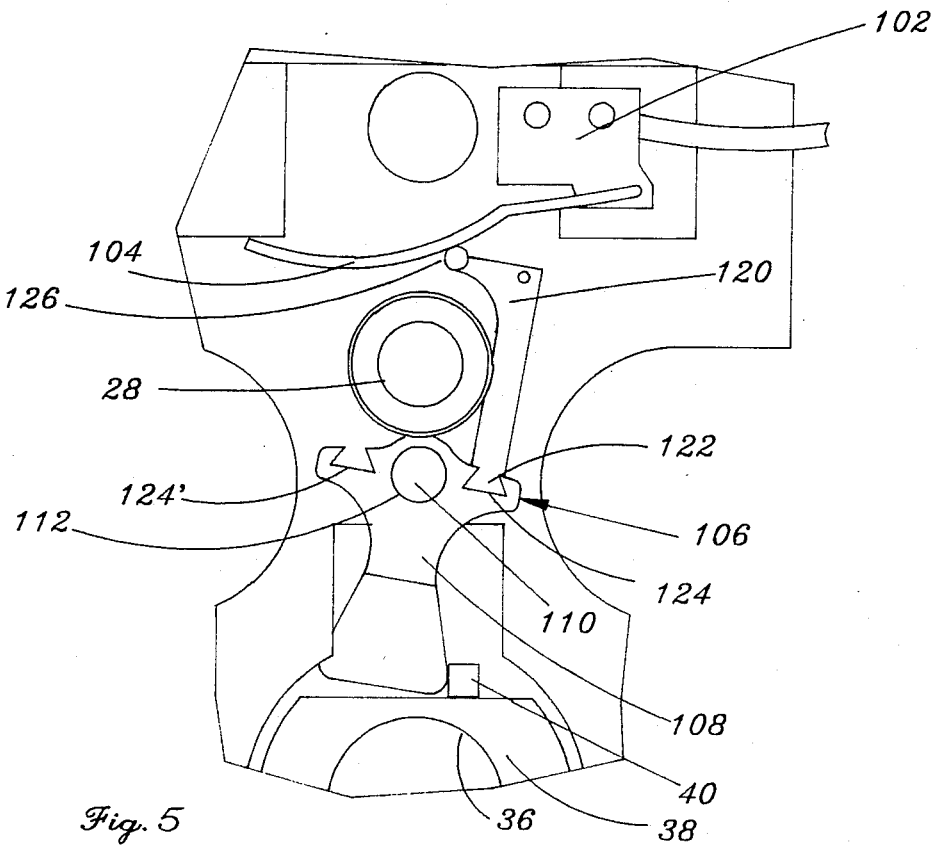
FIG. 5 is a view similar to FIG. 4 but showing the lever moved into second position.

The lockout means, generally designated 100, is best shown in FIG. 4. It comprises a microswitch 102' mounted on the plate 30 just under the battery bracket 42. It has a lead 103 and is provided with a spring operating arm 104 so that when the arm is in the upward position, the switch engages the lockout and when the arm is down, the lockout is disengaged.

Figure 8:
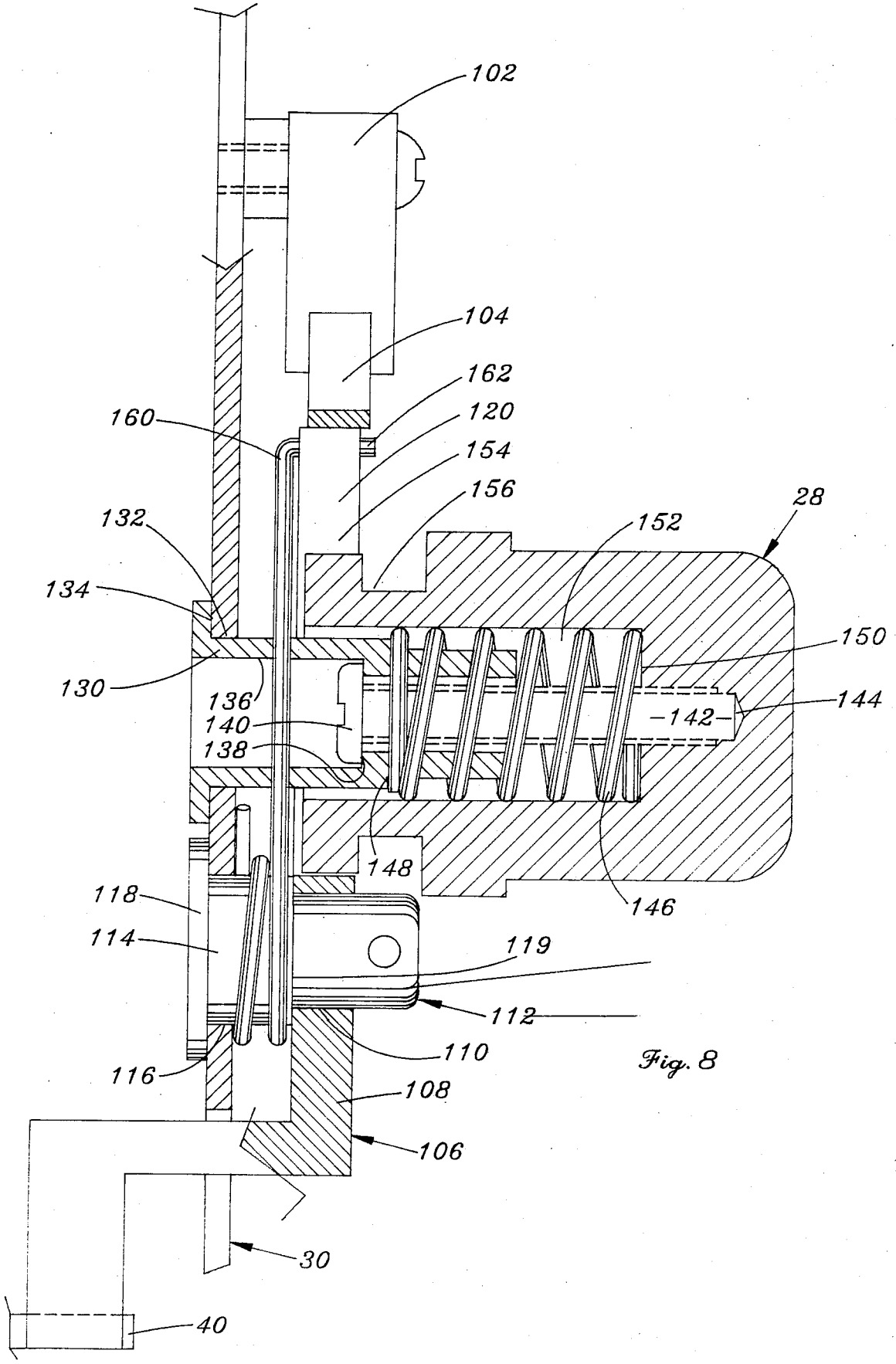
FIG. 8 is a greatly enlarged sectional view taken on the line 8—8 of FIG. 4.

The actuator for changing the position of the switch features the pushbutton 28 and the lever 106. Lever 106 comprises a lower portion 108 which is apertured at 110 and receives a fulcrum pin 112 (FIG. 8). The pin as shown is formed with an enlarged hub 114 which fits snugly in an opening 116 in the plate 30. The hub 114 may have a suitable enlarged flange 118 which abutts the plate 30 and is sandwiched between the plate and the door (not shown in FIG. 8). The pin is reduced to provide a shoulder 119 against which the lever 106 abutts.

The upper portion 120 of the lever has at its bottom a dovetail fitting 122 which fits into a complementary opening 124 in the lower portion 108. Note that a similar complementary opening 124' is provided on the opposite side of the lower half 108 to receive the dovetail fitting 122 in the event of change of hand of the door.

At its top the upper portion 120 has an inward finger 126 which abutts the switch arm 104.

The pushbutton 28 is mounted on a fixed stem 130 (FIG. 8). The stem passes through a suitable opening 132 in the plate 30 and a flange 134 butts up against the plate 30. The stem is tubular, its central bore 136 being reduced outwardly of plate 30 to present a shoulder 138 against which the head 140 of a bolt 142 normally abutts. The outer end of the bolt 142 is screwed into a tapped opening 144 in the inside of the button 28. A spring 146 which bottoms on a shoulder 148 in the stem on one side and the floor 150 of the opening 152 on the other side biases the button in the up position.

The profile of the button includes a peripheral land 154 which normally engages the upper end 120 of the lever 106 and a depressed peripheral land 156 which engages the lever when the button 28 is depressed. A spiral spring 160 winds about the hub 114 of the pin 112 and one end 162 is bent to engage in an opening in the upper portion 120 of the lever. The other end abutts against the stem 130 (FIG. 8). This biases the arm so that its upper end engages the selected land 154 or 156.

In operation, when it is desired to engage the maid lockout the guest pushes the button 28. This moves the button against the bias of spring 146 so that the upper portion 120 of the arm 106 snaps down on to the peripheral land 156, driven by spring 160. In doing so the finger 126 moves the switch 102 to a position in which the lockout is engaged. In this condition the code-receiving and enabling means does not effect the unblocking of the exterior operator 12 despite the entry of a suitable code, for instance, into the slot 24 (FIG. 2).

To cancel the lockout, it is merely necessary for the guest to turn the interior operator 14 so that the pin 40 on the retractor moves leftwardly (FIG. 4, 5) to push the lever 106 out of the recess defined by the land 156 whereby the button 28 springs up. Thereafter when the pin 40 and retractor return to normal position with the latch extended, the lever drops back to engagement with the higher land 154 to permit the arm 104 to drop into its second position whereat the lockout means is not engaged.

It should be noted that the cancelling operation can also be effected as the pin 40 moves leftwardly in the retraction of the latch as it engages the strike mounted on the door frame. Thus, if the occupant depresses button 28 when the door is open and then absentmindedly goes out the door, the automatic closing will cancel the lockout as the latch retracts in latching.

DESCRIPTION OF A MODIFICATION

A modified form of the invention is shown in FIG. 9 through 12 wherein the lock is generally designated 210. It comprises a base plate 230 mounted as in the earlier described embodiment on the opposite side of the door from the housing 22 and its accouterments.

Base plate 230 mounts a cylindrical lockset 232 having its associated latch 234 with a tubular housing 236 all of which is conventional. The cylindrical lockset comprises the U-shaped retractor 238 which engages the tailpiece 240 from the latchbolt in the conventional manner. The shoes 242 and 242' are associated with a retractor so that when the pullback scoop 244 is operated by the inside or outside operator, the latch 234 is retracted.

Of special interest is the canceling pin 246 and 246' which is mounted on the retractor 138 to move therewith. Disposed above the latchbolt is the deadbolt 250 which has a tubular housing 252 secured to the base plate 230. The deadbolt is operated in the conventional way by a turnpiece 254 which is mounted on the outside of a housing 26 (FIG. 1) and which operates a shaft 256 journaled on the base plate 230. Inside the tubular housing 252 (FIG. 11) the deadbolt 250 is provided with a conventional rack 260 which is engaged by a pinion-like shape 262 on the inward end of the shaft 256.

The base plate 230 is formed with a pin 270 to the outer end of which is pivoted a two-piece lever 272 and 274 similar to the structure 108 and 120 of the earlier embodiment.

Figure 9:
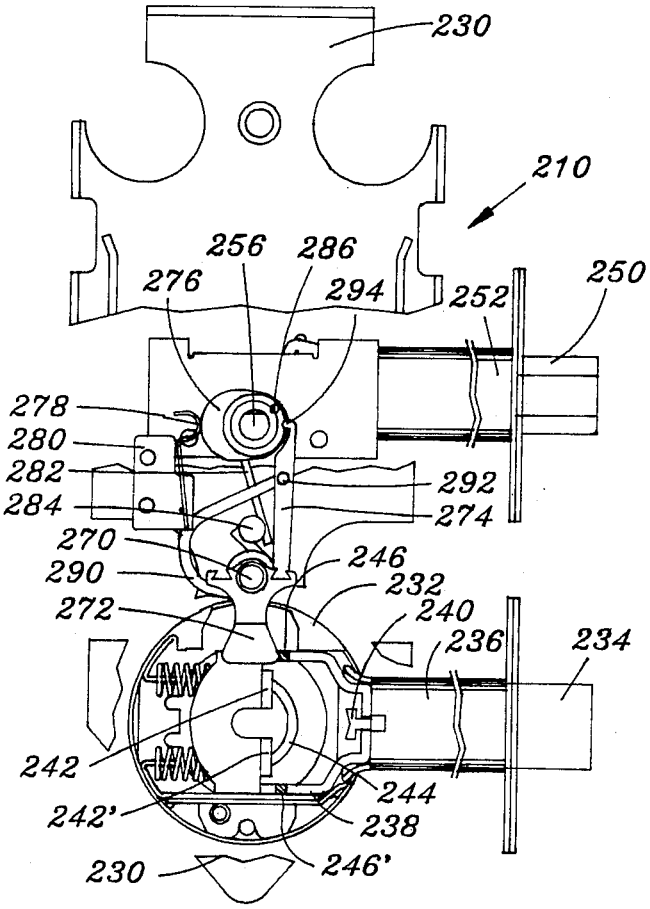
FIG. 9 is a view similar to FIG. 3, an enlarged elevational view showing the inside of the lock system of a modified form of the invention with the housing and knob and part of the base plate removed.
Figure 10:
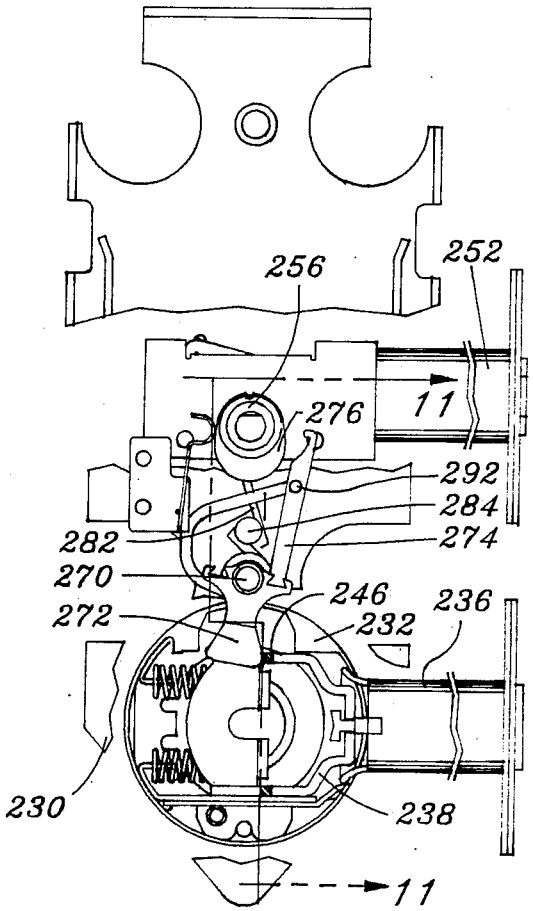
FIG. 10 is a fragmentary view similar to FIG. 9 but showing the lever moved into second position.

As shown in FIG. 9, the lower end 272 of the lever is in the path of the rapidly moving cancelling pin 246 (FIG. 10).

Intermediate the base plate 230 and the turnpiece 254 (FIG. 11) the shaft 256 has fixedly mounted thereon a cam 276. When the turnpiece 254 is turned clockwise to the end of its travel the cam assumes the position of FIG. 9 wherein it engages the actuator arm 278 of the switch 280 mounted on the base plate 230. The switch 280 is connected to the logic circuitry of the lock which is disposed inside a housing similar to housing 22 on the opposite side of the door in the same manner as switch 102 in the earlier version. Thus, as the turnpiece 254 is turned clockwise as in FIG. 9, not only is the deadbolt 250 extended, but also the cam 276 engages the switch 278 to activate the maid lockout.

The arrangement described replaces the pushbutton 28 and related parts.

Figure 11:
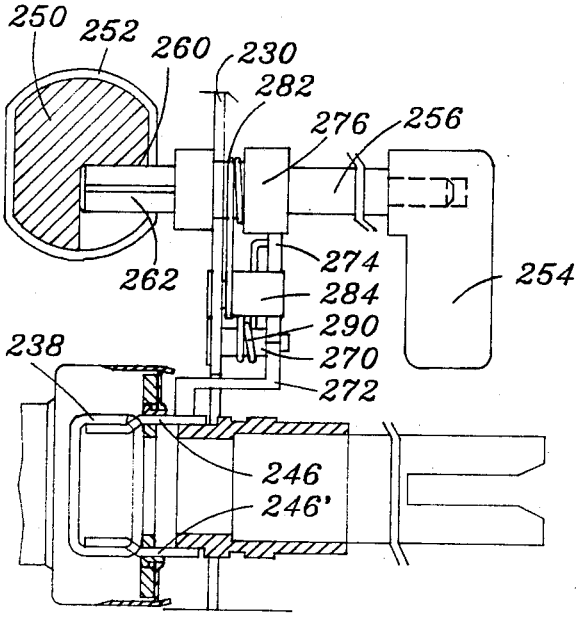
FIG. 11 is a fragmentary sectional view taken on the line 11—11 of FIG. 10.
Figure 12:
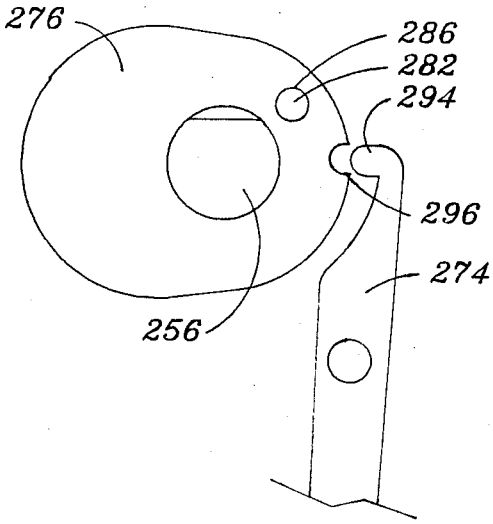
FIG. 12 is an enlarged view of the cam finger arrangement as shown in FIG. 9.

As shown in FIG. 11, a helical spring 282 surrounds the shaft 256 preferably between the cam 276 and the base plate 230. The opposite ends of the spring 282 engage respectively an anchor pin 284 and an opening 286 in the cam. This biases the cam in the counterclockwise direction, biasing the deadbolt in the retracted position.

A second spring 290 surrounds the pin 270 of the lever 272, 274 with one end of the spring extending through an opening 292 in the upper end 274 of the lever and the other end engaging the leftward side of the anchoring pin 284 (FIG. 9). This biases the lever 272, 274 in a counterclockwise direction so that the upper end of the upper portion 274 of the lever rides against the periphery of the cam 276.

The upper end 274 of the lever is formed with an inward finger 294 (FIG. 12) and the cam is formed with an inward notch 296 in its periphery in a position which works out to be opposite the latch lobe of the cam 276 because the switch arm 278 is on the other side of the cam from the notch (FIG. 9).

OPERATION OF THE MODIFIED FORM

In the operation of the modified form, assuming the door is closed, the lockout is effected by turning the turnpiece 254 in a clockwise direction, extending the deadbolt 250 into its keeper in the door frame. This rotation of the turnpiece moves the cam 276 around to the position shown in FIG. 9 engaging the actuator 278 to move the switch 280 into lockout-engaged position.

As described above in connection with the first embodiment, the switch 280 is connected to the circuit board in the housing 126 on the other side of the door so that, despite the otherwise suitable matter of the code fed into the lock, the outside operator continues to be disabled.

When it is decided to disengage the maid lockout, the turnpiece 254 may be turned in a counterclockwise direction forcing the rounded finger 294 out of the notch 296 in the periphery of the cam 276. This causes the cam to rotate counterclockwise disengaging the actuator 278 on the switch 280 and reverting the logic circuitry to lock-out-disengaged condition.

Alternatively, the lockout may be disengaged by simply operating the latch 234 by turning the inside operator. This causes the retractor 238 to move leftwardly along with pin 246 (FIG. 9). Pin 246 engages the lower end of the lower portion 272 of the lever and moves the lever against the urging of the spring 290 in a clockwise direction lifting the finger 294 radially outward from the notch 296 (FIG. 12) and permitting the spring 282 to rotate the shaft 256 in a counterclockwise direction retracting the deadbolt 250.

As an additional alternative, the lockout may be cancelled (if the door is ajar) by merely closing the door. This causes the latchbolt 234 to retract as it engages its strike. This retraction drives leftwardly the retractor 238 and its pin 246. Leftward movement of pin 246 causes it to engage the leg 272, 274 of the lever (FIG. 10). The upper portion 274 of the lever moves rightwardly (FIG. 10) out of the recess 296 permitting the cam 276 to rotate counterclockwise, driven by the spring 282. This, of course, powers the deadbolt 250 into retracted position. At the same time the lobe of the cam 276 moves away from the arm 278, cancelling the lockout feature in the logic circuit in the housing 22 on the other side of the door. Thereafter the maid's keycard and other keycards which were "locked out" will be effective.

DESCRIPTION OF FURTHER EMBODIMENT

Figure 13:
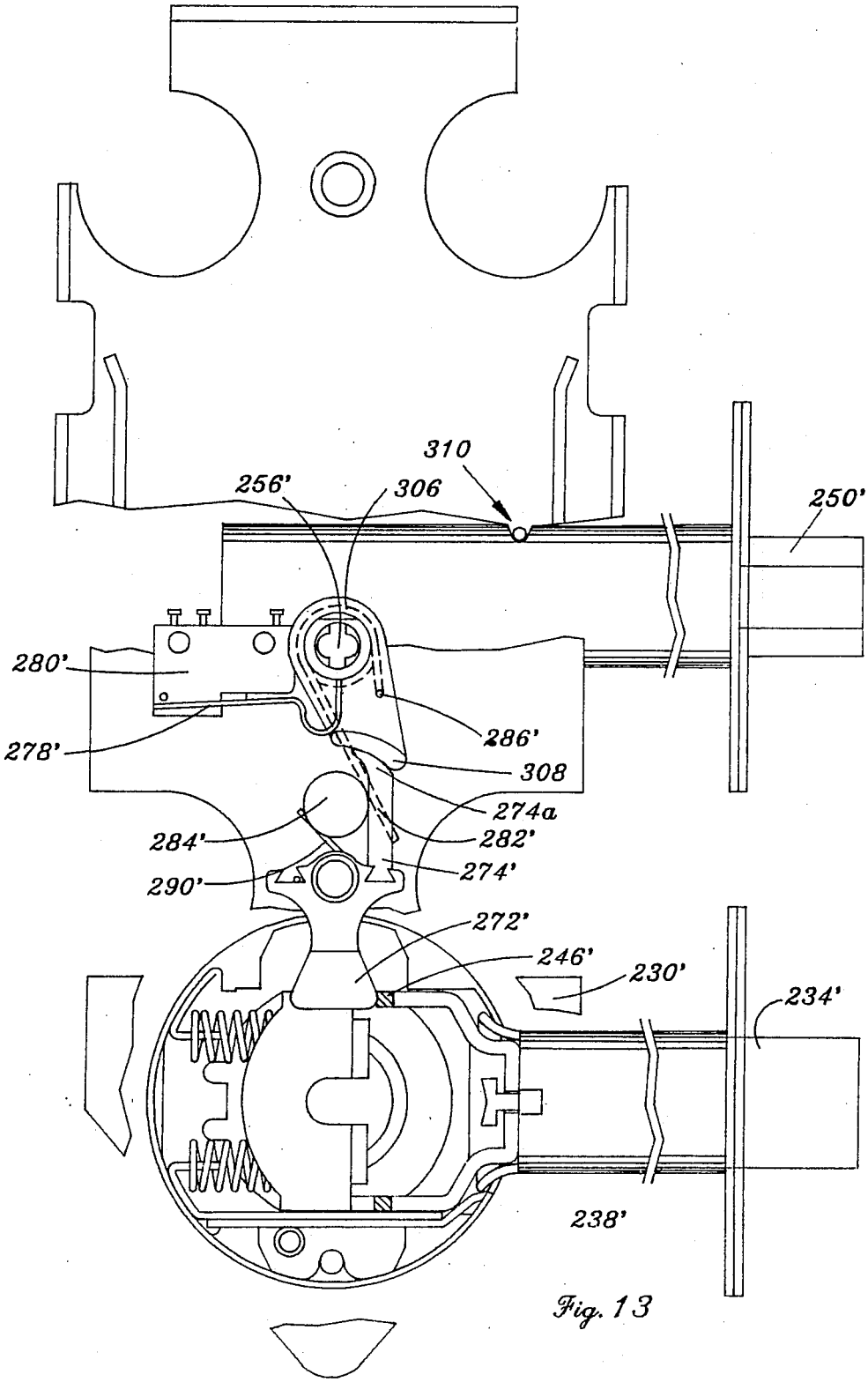
FIG. 13 is an enlarged elevational plan view similar to FIG. 9 of a further embodiment.

In the embodiment shown in FIG. 13 the structure is similar to that shown in FIGS. 9 through 12. The turnpiece drive shaft 256' is, however, provided with a plate 306 which is thickened at its outer end to provide a curved cam 308. This cam is adapted to interact with the curved upper end **274*a* of the upper portion 274' of the lever 272', 274'**.

The actuator arm 278' and the switch 280' are positioned to be engaged by the cam 308 when the deadbolt 250' is extended. A helical spring 282' circumposes the turnpiece 256' and has one end extending through a small opening 286' in the plate 306. The other end of the spring 282' engages the anchoring pin 284' as in the FIG. 9 embodiment. As before, the spring 282' urges the shaft 256' in a counterclockwise direction biasing the deadbolt 250' toward its retracted position.

The primed form of the same reference numeral in the FIG. 9 embodiment is applied to the corresponding part in FIG. 13.

OPERATION OF FURTHER EMBODIMENT

In the embodiment shown in FIG. 13 the maid lockout may be set by turning the turnpiece (not shown) on the shaft 256'. This drives the deadbolt 250' outward into its keeper in the frame until its inner end is engaged by the detent 310, the latter holding the deadbolt in the extended position against the force of the spring 282'.

With the deadbolt in the extended position the cam 308 engages the arm 278' of switch 280' to alter the logic circuit of the code-receiving and enabling means so that the latter does not make the outside operator operable upon receipt of the maid's card.

Subsequently, either upon operation of the inside operator (not shown) or latching of the latchbolt (also not shown) the retractor 238' moves leftwardly (FIG. 13) and in doing so, contacts the leg 272' of the lever 272', 274'. The upper end **274*a* of the lever then moves rightwardly, engaging the underside of the cam 308 to give the turnpiece shaft 256 sufficient force to break the hold of the detent 310 and permit the deadbolt 250' to return leftwardly to its retracted position. At this time, of course, the arm 278' is disengaged by the cam 308** so that the lockout is cancelled.

DESCRIPTION OF STILL FURTHER EMBODIMENT

Figure 14:
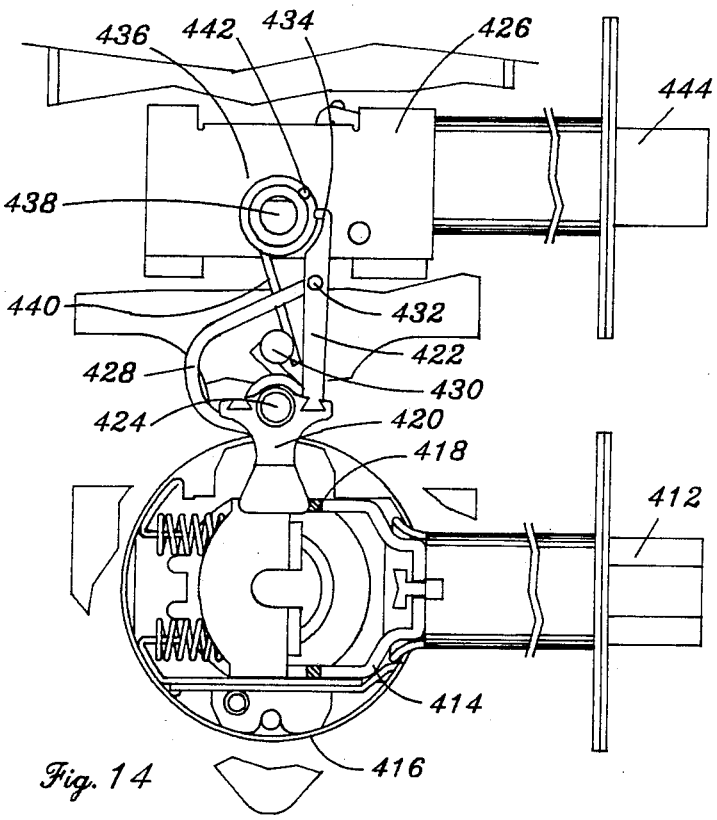
FIG. 14 is a plan view of a further modification of the invention showing the deadbolt and latchbolt in extended position and having part of the base plate removed.
Figure 15:
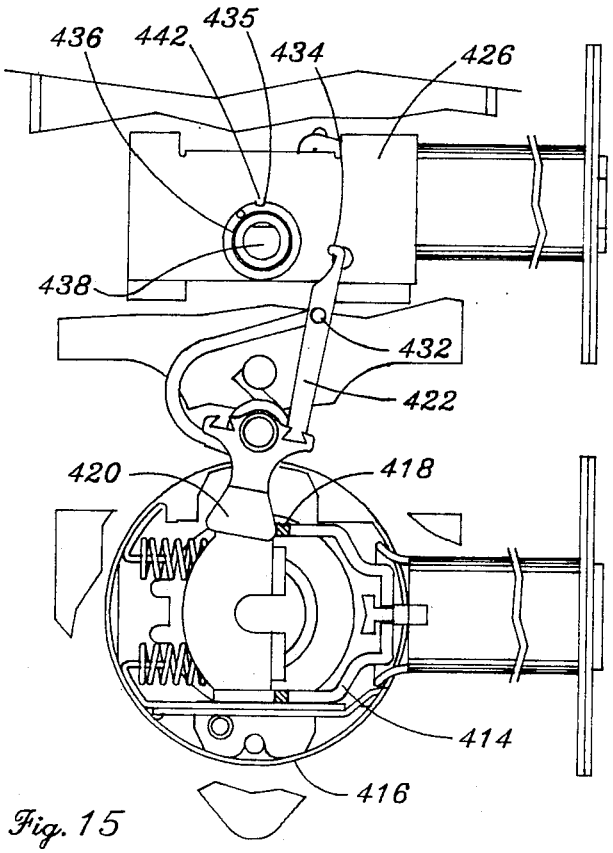
FIG. 15 is a view similar to FIG. 14 but showing the lever in second position.
Figure 16:
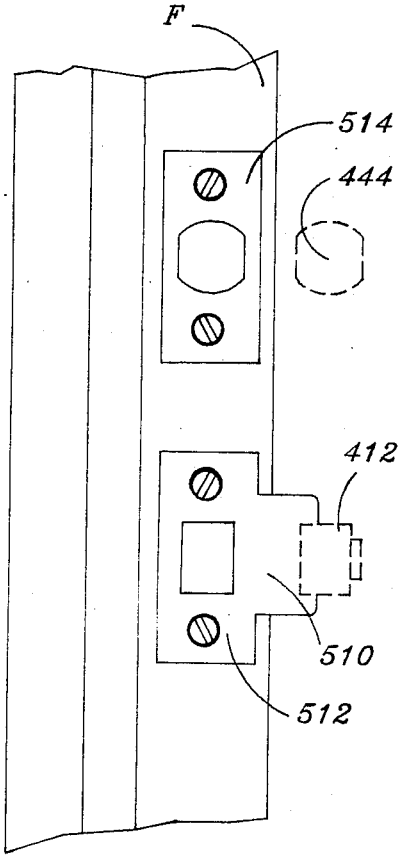
FIG. 16 is a fragmentary plan elevational view of a portion of a door frame associated with the lock of the FIGS. 14, 15 embodiment showing the deadbolt and latchbolt in phantom to demonstrate the operation.

FIGS. 14 through 16 show a still further embodiment of the invention which does not necessarily involve a code-recieving and enabling means. Rather it is directed to the cooperation between the operation of a latchbolt and deadbolt so that the retraction of the latchbolt automatically and immediately causes retraction of the deadbolt. This idea is broadly disclosed in the Stevens patent mentioned above but that device requires operation of the inside operator to retract the deadbolt.

The latchbolt 412 is controlled in the conventional manner as described above by the retractor 414 inside the cylindrical lockset 416. The retractor includes the lateral deadbolt retraction pin 418 having a structure as described in earlier embodiments.

A lever having lower portion 420 and upper portion 422 is pivoted as at 424 between the cylindrical lockset 416 and the deadlatch housing 426. It is biased by the helical spring 428 in a counterclockwise direction as described in earlier embodiments, one end of the spring 428 being tucked against the anchoring pin 430 and the other end passing through a smaller opening 432 in the upper end 422 of the lever.

As with the earlier embodiments, the upper end 422 is formed with a finger 434 which fits into a notch 435 in the periphery of a disk 436 on the turnpiece shaft 438. A second helical spring 440 has one end resting against the anchoring pin 430 and the other end passing through an opening 442 in the disk 436. This biases the shaft 438 of the turnpiece (not shown) in a counterclockwise direction so that the deadbolt 444 is biased in the retracted position.

OPERATION OF THE STILL FURTHER EMBODIMENT

It will be clear from the structure that if the deadbolt 444 is extended into its keeper, the operation of the inside operator (not shown) of the latchbolt 412 will cause the retractor 414 to retract, moving leftwardly the deadbolt operating pin 418 to pivot the lever 420, 422 in a clockwise sense. If the deadbolt is extended at this time, the finger 434 will raise from the notch 435 in the disk 436 and the spring 440 will drive the shaft 438 in a counterclockwise direction retracting the deadbolt 444.

Because the retractor 414 will move leftwardly upon the forced retraction of the latchbolt 412 when it engages its strike, this also will cause the deadbolt 444 to be retracted.

A further application of the concept of the FIGS. 14, 15 embodiment is that the lip 510 of the strike 512 for the latchbolt 412 may be extended as shown in FIG. 16. With this structure when the latchbolt 412 engages the lip 512 in closing, it will be retracted and if, inadvertently or otherwise, the deadbolt 444 is in its extended position (FIG. 16) it will be retracted through the operation of the parts described in connection with FIG. 14.

This retraction will be so rapid that by the time the deadbolt reaches the door frame F, it will be retracted and will not hit the frame. Such contact of the frame, which would otherwise take place, might damage the frame F, the deadbolt 444, the lockset or all of the above. The keeper 514 for the deadbolt 444 is subsequently aligned with the deadbolt 444 in the locking operation.

It is envisioned that the invention may take several different embodiments including reasonable variations of the structures shown. The invention is thus not limited to the disclosed embodiments, but is defined by the following claim language or reasonable equivalents thereof.

What is claimed is:

1. A lock for a door comprising:

a. a lockset including a latch having a horizontally reciprocable latch retractor having a laterally extending pin fixed thereon, a rotatable outside operator having an operating shaft for retracting the latch, normally inoperative, and a rotatable inside operator for retracting the latch, b. electrically operated code-receiving and enabling means adapted upon receiving suitable code input on the outside of the door to make operative the outside operator.

c. lockout means selectively engageable on the inside of the door which, when engaged, alters the code-receiving and enabling means so that it does not make operative the outside operator despite its receiving the suitable code input, the lockout means comprising:

(1) an electrical switch in the lock connected into the code-receiving and enabling means and having a lockout-means-engaged position and a lockout-means-disengaged position, and (2) actuator means for changing the position of the switch including manually operable means for moving the switch to the engaged position and cancelling means comprising the pin on the latch retractor for moving the switch to disengaged position when the latch is retracted.

2. A lock as claimed in claim 1 wherein the actuator means comprises a lever pivotably mounted intermediate its ends on the lock and one end of the lever causes the switch to be in engaged position when the lever is in a first position and causes the switch to be in disengaged position when the lever is in a second position, first biasing means biasing the lever toward first position, the manually operable means comprising a cam element mounted on the lock to move perpendicularly to the lever and having a raised section which holds the lever in second position and a depressed section which permits the lever to assume first position, second biasing means biasing the manually operable means toward a normal position in which the raised section holds the lever in second position, and the pin on the latch retractor engages the other end of the lever when the latch is retracted whereby when the latch is retracted it moves the lever from first position to second position and the manually operable means moves to normal position.

3. A lock as claimed in claim 2 wherein the manually operable means is a push-button mounted on the lock and the second biasing means is a spring disposed inside the pushbutton.

4. A lock as claimed in claim 1 wherein the code-receiving and enabling means will render operative the outside operator upon receiving certain higher level suitable code input despite the engagement of the lockout means.

5. A lock as claimed in claim 1 wherein the actuator means includes a deadbolt, an inside turnpiece having a shaft engaging the deadbolt to throw and retract it, a cam carried by the shaft and adapted when the deadbolt is thrown to move the switch from lockout-means-disengaged position to lockout-means-engaged position, and a lever pivotably mounted intermediate its ends on the lock, one end of the lever being adjacent the cam and the other end being adjacent the retractor, and the pin on the retractor engages and moves the other end of the lever when the latch is retracted whereby when the latch is retracted it moves the lever to cause retraction of the deadbolt and rotation of the cam to move the switch from lockout-means-engaged position to lockout-means-disengaged position.

6. A lock as claimed in claim 5 wherein the cam is spring biased in the direction toward retraction of the deadbolt and detent means holds the deadbolt in extended position until the cam is moved by the lever as the latch is retracted.

7. A lock as claimed in claim 1 wherein a deadbolt biased toward its retracted position is provided parallel to the latch and the deadbolt has an operator shaft parallel to the shaft of the inside operator and the actuator means comprises:

a. a rotary cam fixed on the deadbolt operator shaft and adapted to engage the switch when the deadbolt is extended whereby the deadbolt operator comprises the manually operable means for moving the switch to the lockout-means-engaged position;

b. a lever pivotally mounted intermediate its ends in the lock and having one end for holding the cam with the switch in the engaged position, and holding the deadbolt in extended position; and c. the pin on the retractor engages the other end of the lever to disengage the lever from the cam to permit the biased deadbolt to retract and the cam to turn and permit the switch to move to disengaged position.

* * * * *